US007421992B2

(12) United States Patent
Fritz et al.

(10) Patent No.: US 7,421,992 B2
(45) Date of Patent: Sep. 9, 2008

(54) CAMSHAFT

(75) Inventors: Oliver Fritz, Aichtal (DE); Martin Lechner, Lindlar/Frielingsdorf (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 11/643,611

(22) Filed: Dec. 21, 2006

(65) Prior Publication Data

US 2007/0137598 A1 Jun. 21, 2007

(30) Foreign Application Priority Data

Dec. 21, 2005 (DE) ..... 10 2005 061 187

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,294,218 A 10/1981 King et al.
6,725,817 B2 4/2004 Methley et al.
7,137,370 B2 11/2006 Axmacher et al.
2002/0017257 A1 * 2/2002 Axmacher et al. ..... 123/90.17
2005/0235939 A1 10/2005 Wilke

FOREIGN PATENT DOCUMENTS

DE 102 22 475 A1 12/2003
DE 10 2004 020 124 A1 11/2005
EP 0 582 846 B1 2/1994

* cited by examiner

*Primary Examiner*—Zelalem Eshete
(74) *Attorney, Agent, or Firm*—Collard & Roe, P.C.

(57) ABSTRACT

A camshaft for activation of the gas exchange valves of an internal combustion engine has two coaxially mounted shafts rotatable inside and with respect to one another, first cams fixedly attached to the first shaft and second cams fixedly attached to the second shaft, a main camshaft drive acting on both shafts, and a device for adjusting the angle of rotation of the first and second shafts with respect to one another by a first actuating drive and adjusting the angle of rotation of both shafts jointly by a second actuating drive. The adjusting device has a rapid response and allows large adjustment angles with a simple structural design.

5 Claims, 2 Drawing Sheets

CAMSHAFT

CROSS REFERENCE TO RELATED APPLICATIONS

Applicants claim priority under 35 U.S.C. §119 of German Application No. 10 2005 061 187.7 filed Dec. 21, 2005.

The invention relates to a camshaft for in particular activation of the gas exchange valves of an internal combustion engine according to the preamble of Patent claim 1.

Such a camshaft is known from EP 0 582 846 B1 and U.S. Pat No. 6,725,817, for example. With these camshafts, the two actuating drives are hydraulically actuated. Such hydraulic drives operate relatively sluggishly on the one hand while being temperature-dependent with respect to their control variables on the other hand. In addition, larger adjustment angles are difficult or even and impossible to achieve with the special drive designs mentioned above.

This invention relates to the problem of creating actuating drives that have a quick response and are not dependent on temperature with regard to their regulating accuracy in the case of a generic camshaft, so that practically any large control angles can be achieved easily with these actuating drives. This problem is solved by using a swash-plate drive, which is already known for adjustment of camshafts per se from DE 102 22 475 A1, in a special embodiment according to the characterizing features of Patent claim 1.

Advantageous and expedient embodiments are the subject matter of the subclaims.

The invention is based on the general idea of converting a swash-plate actuating drive, which is known per se for adjusting the angle of rotation of a one-piece camshaft, to a dual actuating drive in a structurally simple manner so that any desired adjustments in the angle of rotation of two shafts mounted coaxially with one another can be achieved in a structurally simple and reliable manner, whereby the angle of rotation of the cams that are connected to one or the other of the two shafts can be adjusted with respect to one another and whereby furthermore a joint adjustment of the angle of rotation of the two shafts is also possible at the same time.

In an advantageous embodiment of the invention, the engaging pieces of the two swash plates engage in a common ring formed on one of the two shaft ends. The engaging pieces are displaceable within the ring in the direction of the joint axis of the two shafts.

The two swash-plate bearings expediently rotate about a common axis of the two shafts.

For a compact design of the actuating drives in a joint adjusting device, the two actuating drives comprised coaxial drive-shafts acting on the swash-plate bearings.

The inventive device having actuating drives consisting of two swash plates permits any adjustments of the two shafts with respect to one another or jointly with respect to the main drive with a corresponding electronic control device.

It is a special advantage of an actuating drive having a swash-plate it allows very high gear ratios to be achieved in a simple manner. The basic principle of a swash-plate drive in the form of a toothed gear consists of the fact that the number of teeth between the gear rim of the swash-plate and the gear rim with which the swash-plate engages differs by only a small number, which in the extreme case may be "one" (1). Such swash-plate mechanisms are known per se in the state of the art, which is why their active principle and design need not be explained in greater detail here. More detailed information with regard to a camshaft swash-plate adjustment drive can be obtained from the aforementioned DE 102 22 475 A1, for example, as already cited above.

An advantageous exemplary embodiment, which is described in greater detail below, is illustrated in the drawing, in which.

Figure 1:
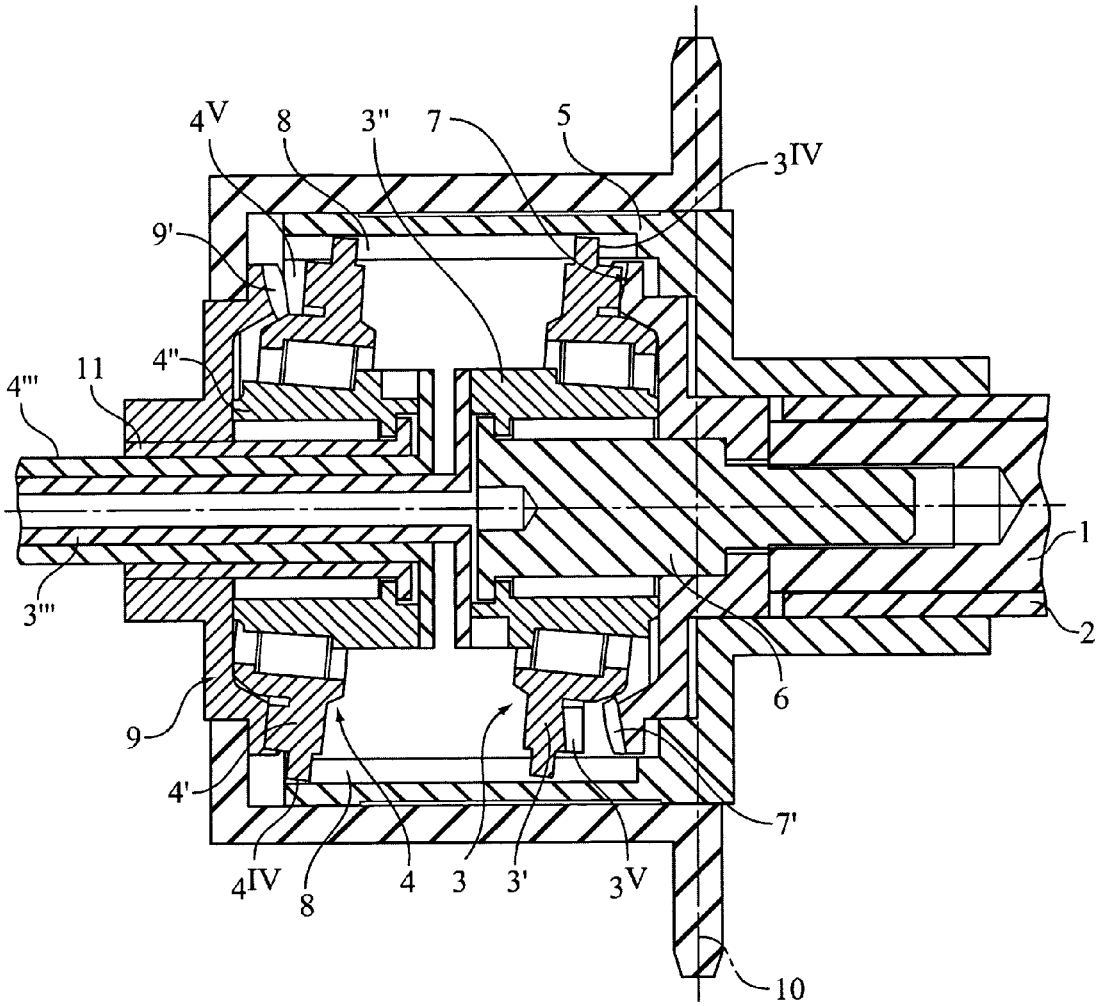
FIG. 1 shows a swash-plate adjusting device with a camshaft in a longitudinal section.
Figure 2:
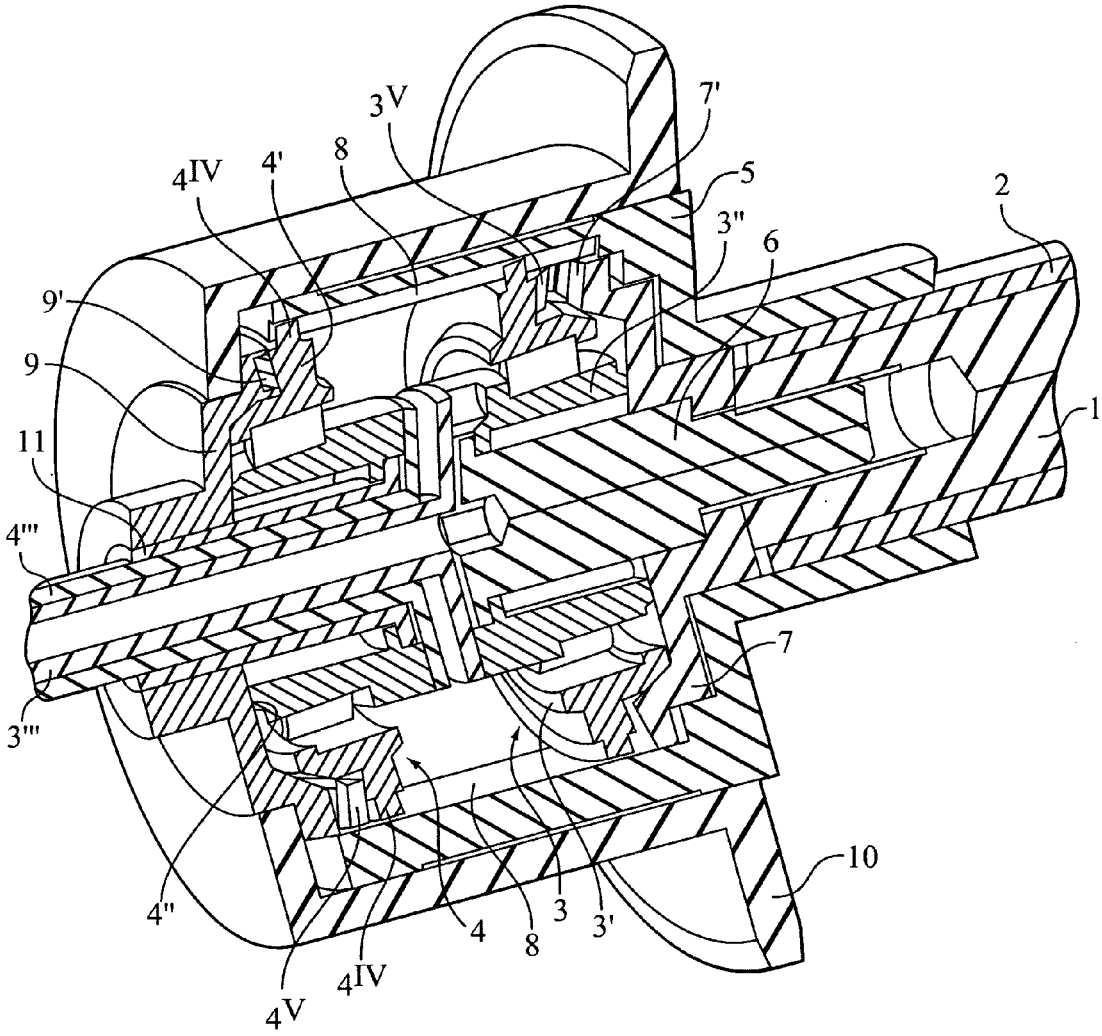
FIG. 2 shows the same adjusting device in a perspective diagram in a housing for the control device, cut away in a longitudinal section according to FIG. 1.

A camshaft consists of coaxially mounted shafts, namely a first shaft 1 as an inside shaft and the second shaft 2 as an outside shaft. Of these two shafts 1, 2, only the sections at one end are shown. The camshaft comprising the two shafts 1 and 2 has first cams, which are fixedly connected to the first shaft, and second cams, which are connected to the second shaft, so that these cams can be rotated oppositely from one another by adjusting the angle of rotation of the two shafts 1, 2. The cams and their fastening on the two shafts 1, 2 are not shown in the drawing.

The two shafts 1, 2 are each connected to a separately operable actuating drive, namely the first shaft 1 being connected to the first actuating drive 3 and the second shaft 2 being connected to the second actuating drive 4. Both actuating drives 3, 4 are designed as swash-plate drives.

A ring 5 having graduated diameters is fixedly connected to the second shaft 2 and the fixed connection is in the ring section having the smaller diameter, while the area having the larger diameter surrounds the two actuators drives 3, 4, of which this area is a component that is to be described in greater detail below.

Each of the two actuating drives 3, 4 consists of the components described below.

A swash plate 3', 4', is rotatably mounted on a swash-plate bearing 3"; 4". The swash-plate bearings 3"; 4" are each driven via an actuating drive shaft, namely a first and a second actuating drive shaft 3'''; 4'''. The first drive shaft 3''' is mounted coaxially inside the second drive shaft 4''' which is designed as a hollow shaft. The first swash-plate bearing 311 is rotatably mounted on a first axle 6 that is fixedly connected to the first shaft 1. A ring wheel 7 is fixedly connected to the first shaft 1.

Engaging pieces $3^{IV}$; $4^{IV}$ which protrude radially outward are provided on the respective outside circumference of each of the swash plates 3'; 4'. These engaging pieces $3^{IV}$; $4^{IV}$ engage in a longitudinal groove 8 on the inside circumference of the ring 5 in the section with a large diameter, with this longitudinal groove running parallel to the common axis of the first and second shafts 1, 2. When there are multiple engaging pieces $3^{IV}$; $4^{IV}$ distributed on the circumference of the swash plates 3', 4', a corresponding number of longitudinal grooves 8 are provided in a corresponding number. In their outer lateral area radially, the two swash plates 3', 4' are each provided with a gear rim, namely a first gear rim and a second gear rim $3^{V}$; $4^{V}$. These gear rims $3^{V}$; $4^{V}$ each engage in respective assigned gear rims. With the first actuating drive 3, such an assigned gear rim 7' is situated on the ring wheel 7.

The second gear rim $4^{V}$ of the second swash-plate 4' engages in a gear rim 9' of a ring sleeve 9. The ring sleeve 9 is fixedly connected to a gearwheel 10 of a camshaft main drive. This main drive has a crankshaft and an internal combustion engine as the drive source, of which the gearwheel 10 is driven via a drive chain (not shown). The second swash-plate bearing 4" is rotatably mounted on a second axle 11 of the second actuating drive 4 fixedly connected to the ring sleeve 9.

The two actuating drive shafts 3''' and 4''' are components of two electric actuator motors that are not shown in the drawing.

With the two actuating drives 3, 4, the swash plates 3'; 4' cooperate with the gear rims 7' and 9' with which they act together with them as reducing gears.

The adjustable camshaft drive functions as follows:

For the case of actuating drives 3, 4 that are switched to inactive mode, the two shafts 1, 2 are driven at the same rotational speed via the gearwheel 10.

If there is an adjustment by the second actuating drive 4 when the first actuating drive 3 is inactive, then both shafts 1, 2 are rotationally adjusted to have the same angle of rotation with respect to the gearwheel 10.

The first actuating drive 3 ensures a mutual adjustment of the shafts 1, 2.

In this way, by a corresponding control of the actuating drives 3, 4, the angles of rotation of the shafts 1 and 2 can be adjusted jointly and easily with respect to one another and with respect to the main drive acting via the gearwheel 10.

All the features depicted in the description and in the following claims may be essential to the invention either individually or combined together in any form.

The invention claimed is:

1. A camshaft for, in particular, activation of the gas exchange valves of an internal combustion engine, comprising two coaxially mounted shafts rotatable in and against one another, namely a first and a second shaft (1; 2), first cams fixedly attached to the first shaft (1) and second cams fixedly attached to the second shaft (2), a main camshaft drive acting on both shafts (1, 2), and a device for adjusting the angle of rotation of the first and second shafts with respect to one another by means of a first actuating drive on the one hand and on the other hand adjusting the angle of rotation of both shafts (1, 2) of the camshaft jointly by a second actuating drive (4), characterized by the features the two actuating drives (3, 4) each have a swash-plate mechanism having swash plates 3'; 4', each mounted rotably about the joint camshaft axle on a swash-plate bearing (3"; 4") and each being provided with a gear rim ($3^{V}$; $4^{V}$) and each with at least one engaging piece ($3^{IV}$; $4^{IV}$), the engaging pieces ($3^{IV}$; $4^{IV}$) of the two swash plates ($3^{IV}$; $4^{IV}$) cooperate directly with one of the two shafts (1, 2), of the swash plates (3'; 4'), one cooperates via its respective first gear rim ($3^{v}$) with one of the two shafts (1; 2) and the other cooperates by its respective second gear rim ($4^{v}$) with a gear rim (9') of an actuating drive shaft of the main drive.

2. The camshaft according to claim 1, characterized in that the engaging pieces ($3^{IV}$; $4^{IV}$) engage in longitudinal grooves (8) in a ring (5) attached to one of the two shafts (1, 2).

3. The camshaft according to claim 1 or 2, characterized in that both swashplate bearings (3"; 4") rotate about the joint axis of the two shafts (1, 2).

4. The camshaft according to any one of the preceding claims, characterized in that the two actuating drives (3, 4) comprise drive shafts (3'''; 4''') that are designed to be coaxial with one another and act on the swash-plate bearings (3"; 4").

5. The camshaft according to any one of the preceding claims, having a control device for any adjustment of the angle of rotation of the two shafts (1, 2) with respect to one another and/or jointly with respect to the camshaft main drive.

* * * * *